US005456315A

United States Patent [19]

Kisman et al.

[11] Patent Number: 5,456,315

[45] Date of Patent: Oct. 10, 1995

[54] HORIZONTAL WELL GRAVITY DRAINAGE COMBUSTION PROCESS FOR OIL RECOVERY

[75] Inventors: Kenneth E. Kisman; Ben I. Nzekwu; Edmund C. Lau, all of Calgary, Canada

[73] Assignee: Alberta Oil Sands Technology and Research, Edmonton, Canada

[21] Appl. No.: 189,966

[22] Filed: Feb. 1, 1994

[30] Foreign Application Priority Data

May 7, 1993 [CA] Canada ..... 2096034

[51] Int. Cl.[6] ..... E21B 43/243; E21B 43/30

[52] U.S. Cl. ..... 166/245; 166/50; 166/261; 166/263; 166/272

[58] Field of Search ..... 166/50, 245, 256, 166/261, 263, 306

[56] References Cited

U.S. PATENT DOCUMENTS

| | | | |
|---|---|---|---|
| 2,365,591 | 12/1944 | Ranney | 166/306 |
| 2,901,043 | 8/1959 | Campion et al. | 166/261 X |
| 2,958,519 | 11/1960 | Hurley | 166/261 X |
| 3,044,545 | 7/1962 | Tooke | 166/261 X |
| 3,441,083 | 4/1969 | Fitzgerald | 166/245 |
| 3,727,686 | 4/1973 | Prates et al. | 166/261 |
| 3,794,113 | 2/1974 | Strange | 166/245 |
| 4,356,866 | 11/1982 | Savins | 166/50 X |
| 4,384,613 | 5/1983 | Owen et al. | 166/245 X |
| 4,390,067 | 6/1983 | Willman | 166/245 |
| 4,422,505 | 12/1983 | Collins | 166/256 |
| 4,454,916 | 6/1984 | Shu | 166/260 |
| 4,566,537 | 1/1986 | Gussis | 166/261 |
| 4,573,531 | 3/1986 | Garkusha et al. | 166/50 X |
| 4,718,485 | 1/1988 | Brown et al. | 166/50 |
| 5,211,230 | 5/1993 | Ostapovich et al. | 166/245 |
| 5,273,111 | 12/1993 | Brannan et al. | 166/50 X |

*Primary Examiner*—George A. Suchfield
*Attorney, Agent, or Firm*—Dennis T. Griggs

[57] ABSTRACT

An in-situ combustion method is provided for the recovery of viscous oil from an oil-bearing reservoir. A linear array of vertical air injection wells is drilled into the reservoir; the wells are completed in the upper portion of the reservoir. One or more gas production wells are provided, remote from the row of injection wells, said gas production wells also being completed in the upper portion of the reservoir. A horizontal oil production well is completed in the bottom portion of the reservoir, aligned with and positioned in spaced relation beneath the vertical injection wells. The reservoir is prepared for ignition and combustion is initiated at each of the injection wells. A hot fluid-transmissive chamber is formed around each of the injection wells as combustion proceeds. Combustion gas communication is established with the gas production wells. Heated oil and water, produced by the combustion front in each hot chamber, drains under the effect of gravity and is produced from the horizontal production well. The main features of the process are the implementation of gravity drainage to a basal horizontal well in a combustion process and the splitting of liquid and gas production.

6 Claims, 4 Drawing Sheets

HORIZONTAL WELL GRAVITY DRAINAGE COMBUSTION PROCESS FOR OIL RECOVERY

FIELD OF THE INVENTION

This invention relates to a process for recovering viscous hydrocarbons from a subterranean reservoir using an in-situ combustion technique in combination with a particular arrangement of vertical air injection wells, gas production wells, and separate horizontal oil production wells.

BACKGROUND OF THE INVENTION

Combustion or fireflood methods are known for enhanced recovery of oil from viscous oil reservoirs.

Generally, the reservoir is locally heated and then oxygen is supplied to the oil bearing reservoir through one or more injection wells. The injection of oxygen sustains combustion of in-situ oil and forms a vertical combustion front which produces hot gases. The combustion front advances towards production wells spaced from the injection wells.

The known combustion processes may be generally characterized as comprising: a burnt zone closest to the injection well; a combustion front; a vapour zone; a condensation layer; an oil bank; and finally a cool region which oil must flow through to be produced from a well. The combustion progresses in essentially a plug flow manner. This plug flow progression experiences the following disadvantages: the lighter hydrocarbons are in a layer ahead of the combustion, leaving only variable quality coke behind as fuel; and it is difficult to supply and maintain adequate oxygen levels, for continued combustion, at the ever extending front.

Ideally, the combustion front remains vertical, extending throughout the depth of the reservoir. If the combustion front contacts the entire reservoir, then maximum production efficiency may be achieved.

Ultimately however, over time the hot gases rise and tend to move laterally through the upper reaches of the reservoir toward the production wells. This phenomenon is referred to as "overriding". The results of overriding are uneven areal distribution of the combustion front and premature breaking through of gases at one or more production wells. This latter situation is characterized by high gas flow rates coupled with high temperature and oxygen effects at the production well. The need to produce oil and water accompanied by a prolific combustion gas flow through a single production well leads to high entrainment of sand, the formation of emulsions, and poor oil recoveries. Further, the production well may be damaged by burning at the well. Excessive sand rates can plug screens and impair the operation of downhole production pumps.

It is therefore an objective of this invention to improve the production efficiencies of combustion front enhanced oil recovery techniques and reduce the risks to production equipment.

SUMMARY OF THE INVENTION

The invention involves a combination of steps comprising:

providing a row of injection wells, vertically disposed and completed in the upper part of the reservoir, for injecting oxygen-containing gas into the reservoir to support a combustion front therein;

providing at least one gas production well, spaced remotely from the row and completed in the reservoir, for producing the combustion gases;

providing a horizontal oil production well, completed in spaced relation below the injection wells and being generally aligned with the row, for producing hot liquid oil and water;

optionally cyclically stimulating the reservoir with steam through the injection wells and the oil production well to establish fluid communication between the injection wells and the oil production well;

injecting an oxygen-containing gas at less than fracturing pressure through each injection well and establishing a combustion front emanating from each such well to form a hot gas-containing, fluid transmissive chamber extending around each injection well and down to the oil production well, so that heated oil and water will drain downwardly through the chamber under the influence of gravity, said combustion front further being operative to produce combustion gases which flow through the upper portion of the reservoir, as an "overriding" stream, toward the gas production well(s) for production therefrom; and producing hot oil and water in liquid form through the horizontal oil production well and combustion gases through the gas production well(s).

It will be noted that the process is characterized by the following features:

there is split production of the liquid and gaseous products of the process;

because the hot oil and water liquids are recovered by draining under the influence of gravity down to the oil production well and they are produced to ground surface through that well; and because the combustion gases are recovered by forming an overriding stream moving through the upper reaches of the reservoir to the gas production well(s) and they are produced to ground surface through those wells.

However, it needs to be understood that the split is not totally complete—minor amounts of liquids are produced with the gases and minor amounts of gases with the liquids.

The process is further characterized by the following advantages:

the energy efficiency and low cost of a combustion process is combined with the high recovery associated with gravity drainage to a horizontal production well;

early gas breakthrough to the gas production wells can be avoided by locating the wells remote from the injection wells, which is not a problem to implement because the heated oil does not get produced by the gas production wells—therefore the wells do not need to be relatively closely spaced relative to the injection wells so that the oil can be driven to them;

the gas production wells can be water cooled to better combat problems arising from the arrival of the hot combustion gases;

downhole pumps can be eliminated from the gas production wells, thereby avoiding gas locking and reducing corrosion problems;

the process provides a hot fluid-transmissive chamber for the hot oil to flow through on its way to the oil production well, thereby facilitating oil movement;

there is only a relatively short distance spacing the combustion front from the horizontal oil production well;

the horizontal oil production well is protected from combustion damage, since the oxygen flux and combustion front tend to stay higher in the reservoir and liquid overlies the oil production well and insulates it from the combustion front;

production from the horizontal oil production well can be controlled at low gas flow rates through it, to maintain a small head of liquid over the well; and low air-injection pressure can be used because only gravity forces are required to displace oil to the oil production welll, whereas in prior art combustion processes higher pressures are required to drive oil between injection and production wells.

DETAILED DESCRIPTION OF THE PREFERRED EMBODIMENT

Figure 1:
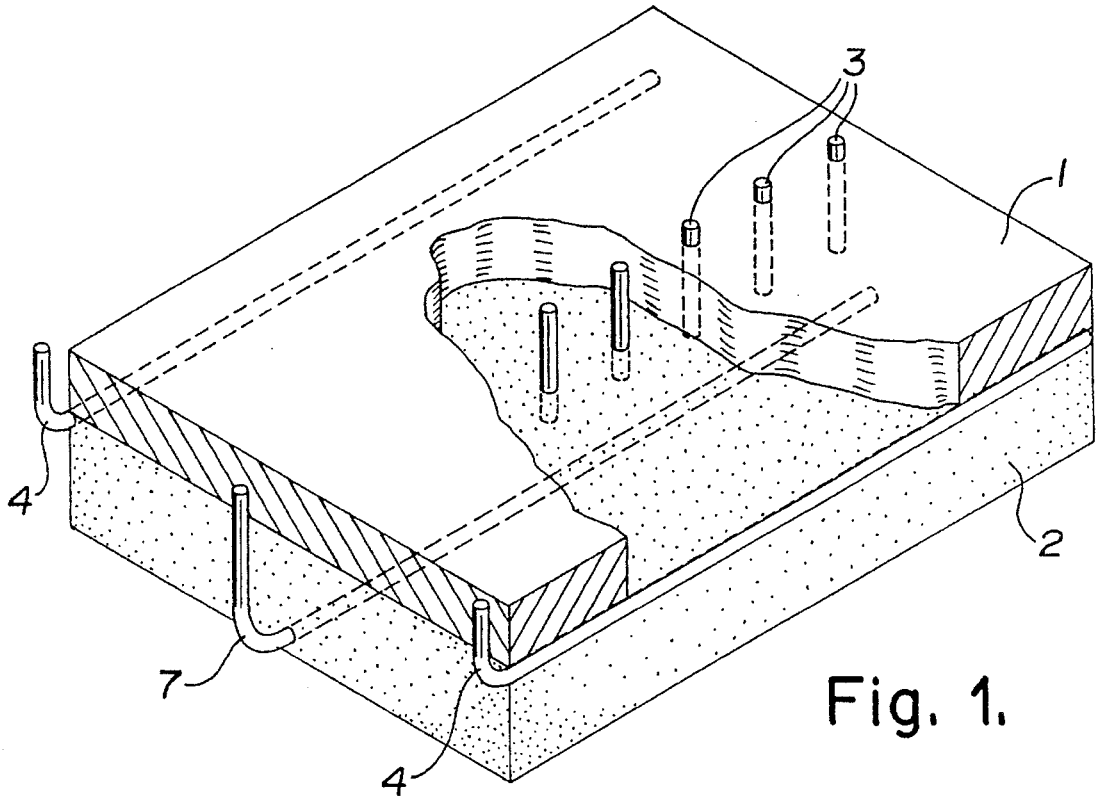
FIG. 1 is a perspective schematic view of a section of an oil-bearing reservoir with injection wells, gas production wells, and oil production wells in place. The overburden has been partially cutaway.

Referring to FIG. 1, one may view a cutaway perspective view of an oil-bearing reservoir and the arrangement of wells used to carry out the method of the invention.

A covering of overburden 1 lies above an oil-bearing reservoir 2. A row of vertical injection wells 3 are drilled downward through the overburden 1 and are completed in the upper portion of the reservoir 2.

Remote gas production wells 4 are drilled spaced apart and in a line parallel from the row of injection wells 3. These primarily gas production wells 4 are also completed in the upper portion of the reservoir. The gas production wells 4 are spaced one on either side of each row of injection wells for optimal utilization of the injection wells.

In the embodiment shown, horizontal gas production wells 4 are used. Optionally, a series of vertical gas production wells could be used in place of the horizontal wells 4. These vertical gas production wells would also be completed in the upper portion of the reservoir initially, but could be recompleted lower in the reservoir at late stages of the process.

A horizontal oil production well 7 is provided near the base of the reservoir 2. Each oil production well 7 is aligned with and positioned in spaced relation beneath the perforations of a row of injection wells 3. Each oil production well 7 will typically have a slotted liner (not shown) to permit ingress of produced fluid. The oil production well 7 collects and recovers the oil and water liquid product from the reservoir 2.

In the case where the oil reservoir is saturated with low mobility heavy oil, it is desirable to conduct a preheating step to form an initial hot, fluid transmissive chamber 9 linking each injection well 3 and the oil production well 7, whereby fluid communication can be established between the wells. This can be accomplished by subjecting the reservoir to cyclic steam stimulation through the injection wells 3 and oil production well 7. During cyclic steam injection, oil is recovered from both the oil production well 7 and the gas production wells 4. When the reservoir 2 is sufficiently preheated, combustion is initiated. Preheating with steam may require a three month duration. In the case where the oil reservoir is saturated with mobile oil, preheating with cyclic steam stimulation may not be required. Optionally a downhole burner may be used to initially heat the area around each injection well 3 to start combustion.

Figure 2:
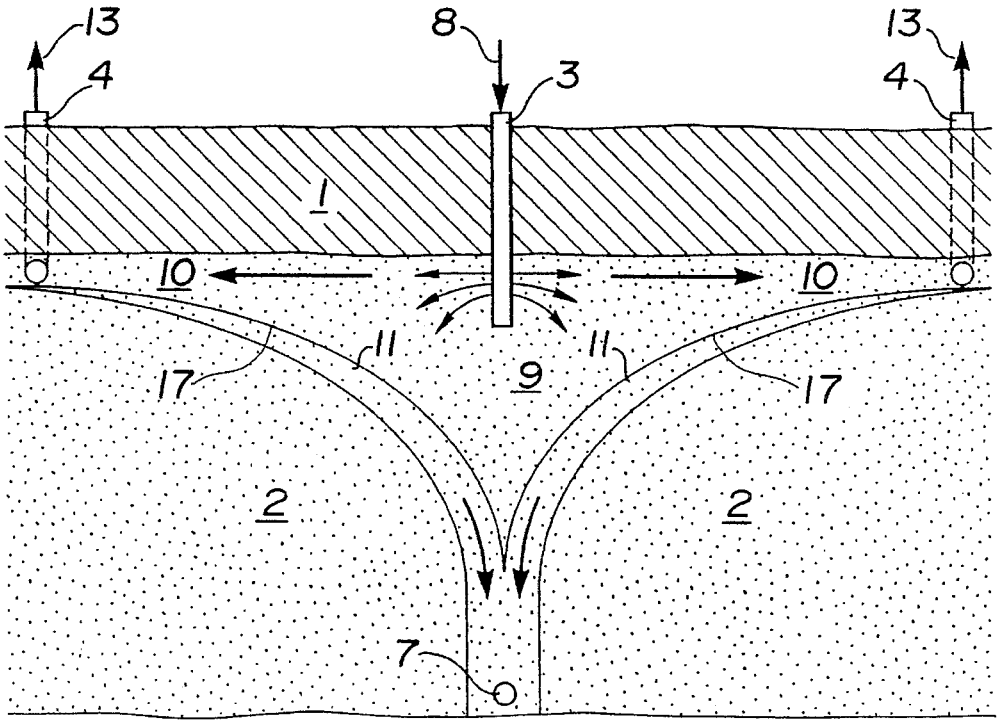
FIG. 2 is a schematic diagram of a cross section of the reservoir perpendicular to the horizontal oil production well.

Referring to FIG. 2, gas containing oxygen 8 is injected through each of the injection wells 3 at less than fracturing pressure, to initiate combustion. Air is usually used, however it may be substituted directly with oxygen or with recycled gases enriched with oxygen. Water may also be injected continuously or as slugs to improve the combustion process.

A fluid-transmissive chamber 9 is formed around each injection well 3. The chamber 9 is hot, fluid transmissive, and gradually extends downwardly until it establishes fluid communication between the injection wells 3 and the oil production well 7.

Continuous gas injection and cold water circulation in the injection wells can be used to minimize combustion damage to the wells.

A thin overriding gas layer 10 is formed, extending to the gas production wells 4. The pressures at the injection wells 3 and at the gas production wells 4 are almost the same once combustion is well established. If communication between the injection wells 3 and the gas production wells 4 is initially insufficient, gas can be injected through the injection wells 3 to create a communication path prior to initiation of combustion.

In the early phases of the initiation of combustion, the rate of oil being produced from the gas production well 4 declines quickly, while the oil rate of the horizontal production well 7 increases. A stable combustion front 17 is soon developed, forming a fluid-transmissive chamber 9 localized about each of the injection wells 3 and extending down to the oil production well 7. Eventually, as the overriding gas layer 10 is established, the gas production wells 4 produce substantially only combustion gases 13.

The gas production wells 4 may be spaced far enough away from the injection wells 3 so that the produced gas 13 is sufficiently cooled to avoid combustion damage related to residual contained oxygen. Should the gas production wells 4 experience heating, they can be cooled with water circulation. The water circulation will not adversely affect oil production and quality, as liquid production is now occurring at the separate oil production well 7.

The flow mechanisms guiding the behaviour at the combustion front 17 are somewhat different from those understood to occur in the prior art plug flow combustion processes.

Figure 3:
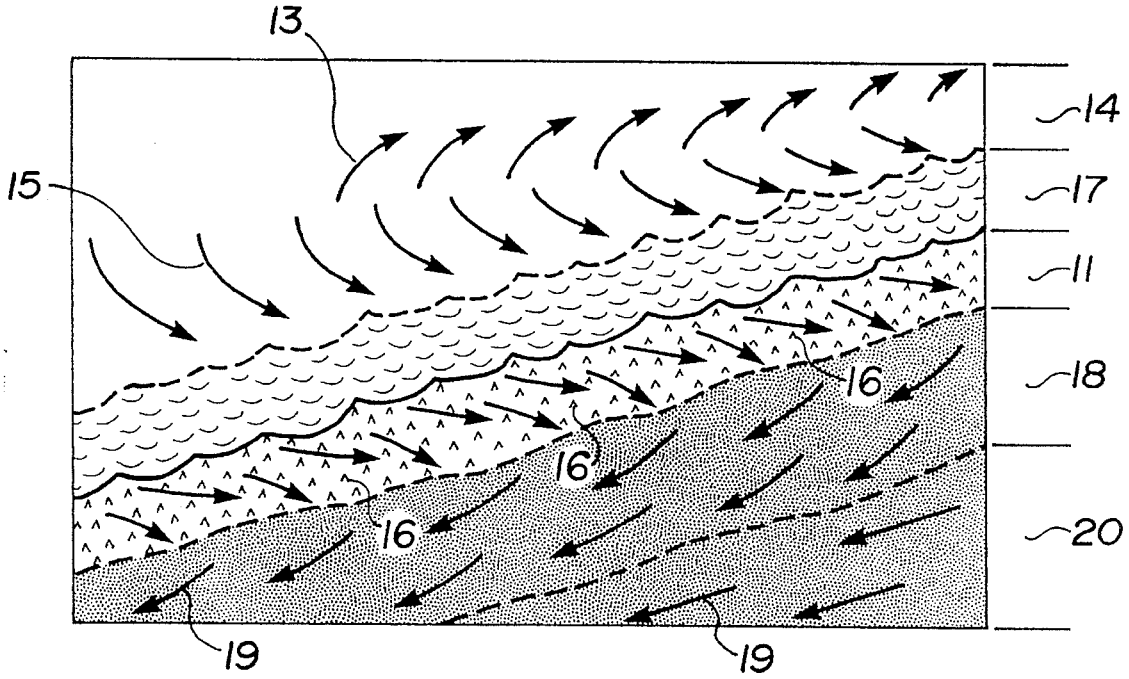
FIG. 3 is a fanciful schematic view of the combustion front corresponding to area A according to FIG. 2.

Referring to FIG. 3, the mechanisms believed to occur at the combustion front are separately identified. Mass transfer processes occur in a burnt zone 14 in the area of the upper portion of the reservoir 2, which act to draw fresh air and oxygen 15 down to the combustion front 17, maintaining efficient combustion.

Light hydrocarbons 16, released by the heat transmitted from the high temperature combustion front 17, rise through to a transition layer 11, providing high grade fuels to the combustion process. The combustion process extends throughout the transition layer and combustion front areas, consuming coke, light hydrocarbons and oxygen, leaving water vapor, nitrogen, and carbon dioxide. Hydrocarbons are either burned or drain downward from this area.

Combustion water vapor condenses in a condensation layer 18 in the cooler layers ahead of the transition layer 11. This transfers heat to the oil-bearing reservoir 2, mobilizing the oil and condensing water 19, which drains towards the production well 7.

Conduction of heat from the condensation layer 18 then acts as the primary heat transfer mechanism to heat and mobilize more oil and water flow 19 in a conduction zone 20, draining to the horizontal production well 7.

The process has been numerically simulated to verify the physical principles of the design and evaluate its potential over the prior art.

In order to forecast production, a three dimensional (3-D) model was prepared to simulate the process.

Figure 4:
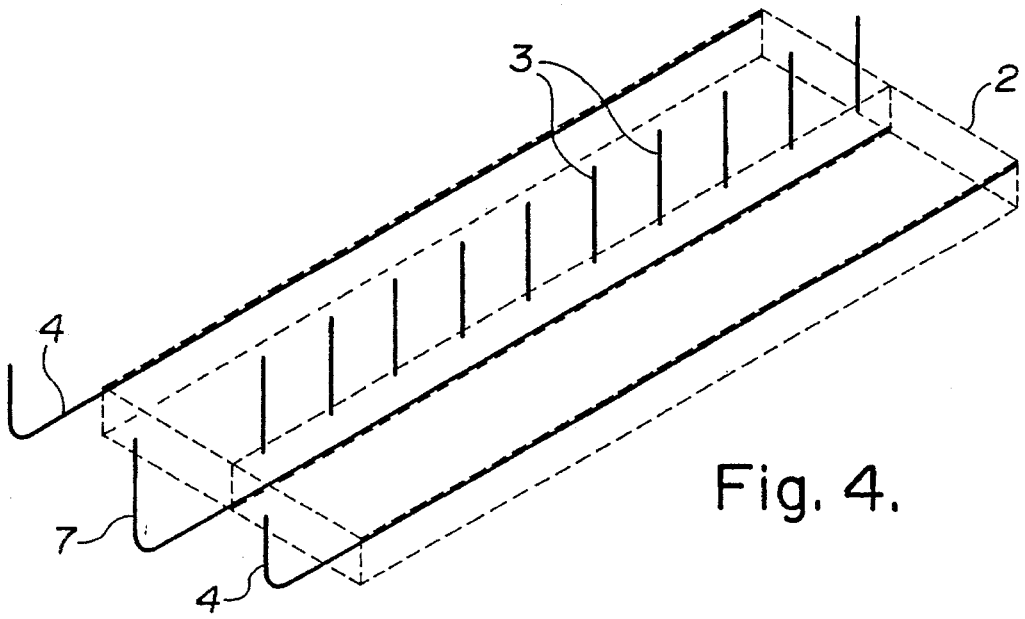
FIG. 4 is a perspective view of a modelled reservoir.

Referring to FIG. 4, a 16 meter deep reservoir was modelled with a 480 meter long horizontal production well placed near the bottom. Two horizontal gas production wells were placed in the upper portion of the reservoir. Each gas production well was 72 meters spaced apart from and parallel to the production well. Ten vertical injection wells were placed into the upper portion of the reservoir, aligned along the horizontal production well and spaced 48 meters apart. This then defines a 480 meter long by 144 meter wide by 16 meter deep overall model.

Figure 5:
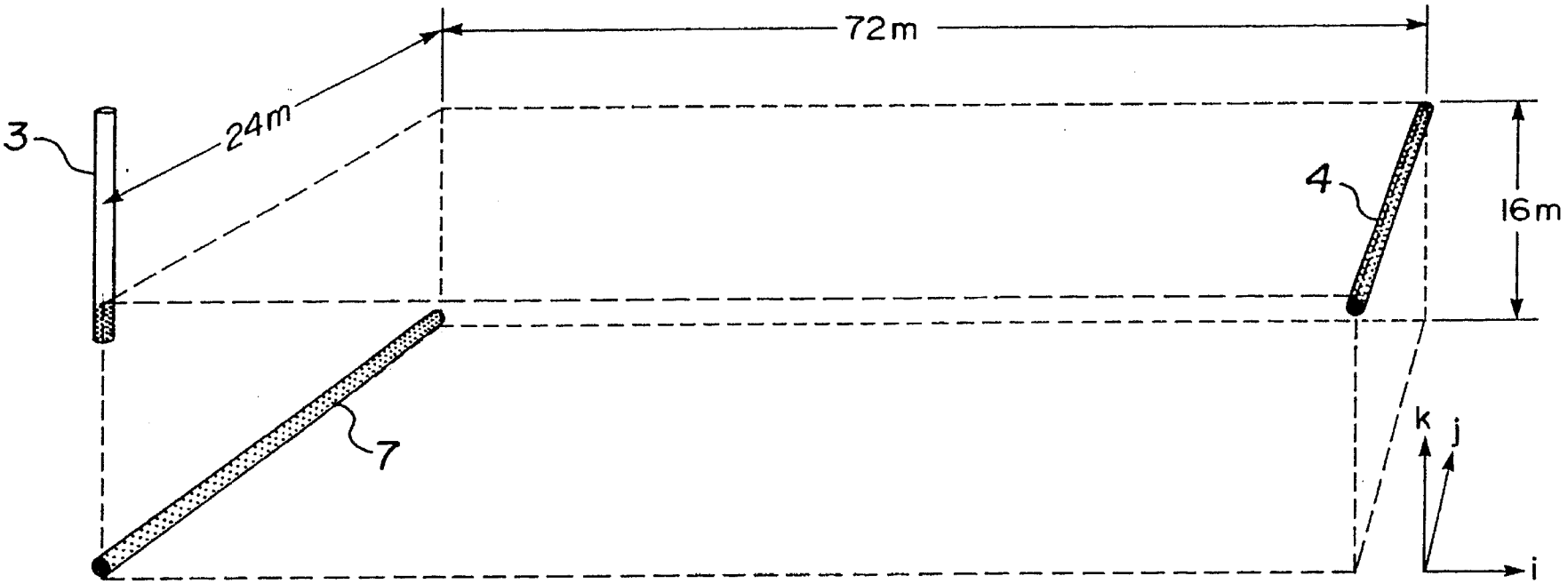
FIG. 5 is a perspective view of a discrete 3-D model element according to the overall model of FIG. 4.

Referring now to FIG. 5, considering the symmetry of the 3-D computer model, one has only to consider one lateral side of one injector. Thus the actual reservoir modelling element was 24 meters long by 72 meters wide by 16 meters deep.

In order to better study the process mechanisms through the combustion front (FIG. 3), an additional 2-D model was used, extending through the 16 meter depth and to the gas production wells, 72 meters away. A commercial simulator sold under the trademark "CMG Stars" by Computer Modeling Group of Calgary, Alberta was used to simplify creation of the model. The "CMG STARS" simulator is a simulation package for steam and additive reservoir simulation. The simulation routines provided can handle many aspects of reservoir modelling, some of which include: vertical and horizontal wellbores, multi-component oils, steam, gases, combustion and channelling analyses.

Hydrocarbons behaviour was simulated using a two component system: a non-volatile heavy component and a volatile light component. The heavy component was assumed to burn in its liquid phase when exposed to oxygen. The light component was assumed to be volatile and burns in its gas phase only. No cracking reactions were modeled.

The actual reaction kinetics were not specifically modelled, as they were believed to be unreliable in a coarse grid system as modeled. The process is more conducive to high temperature combustion because there is gas and liquid phase combustion as well as coke combustion. Heat generation was based upon spontaneous and complete conversion of the hydrocarbons to combustion byproducts when exposed to oxygen.

The gravity draining behaviour of steam heated oils in reservoirs is known through studies of Steam-Assisted Gravity Drainage (SAGD) developed by R. M. Butler et al., "Theoretical Studies on the Gravity Drainage of Heavy Oil during In-Situ Steaming Heating", Can. J. Chem. Eng., Vol. 59, P. 455–460, August 1981, and pilot-tested in the Athabasca Oilsands near Ft. McMurray, Alberta. The hot chamber was assumed to act similarly to a steam chamber acting in the SAGD process.

The properties of a high density heavy oil and a low density heavy oil reservoir and its hydrocarbon components used for the model are listed in Table 1 as follows.

| RESERVOIR PROPERTIES | | | | |
|---|---|---|---|---|
| | units | | Reservoir Rock | Overburden & Underburden |
| Pay Thickness | (m) | | 16 | |
| Porosity | | | 30% | |
| Oil Saturation | | | 83% | |
| Water Saturation | | | 17% | |
| Gas Saturation | | | 0% | |
| Solution GOR | ($m^3/m^3$) | | 12.40 | |
| H. Permeability | (Md) | | 3000 | |
| V. Permeability | | | 2000 | |
| Res. Temperature | (C) | | 26.8 | |
| Res. Pressure | (kPa) | | 5450 | |
| Rock Compressibility | (/Kpa) | | 0.000035 | |
| Conductivity | (J/m.d.C) | 149500 | 149500 | |
| Heat Capacity | ($J/m^3.C$) | | 2347000 | 2347000 |
| **OIL PROPERTIES** | | | | |
| | Units | Heavy Component | Light Component | Live Oil |
| (a) High Density Heavy Oil | | | | |
| Density | ($kg/m^3$) | 994 | 866 | 977 |
| Viscosity | (cp) | 4875 | 17 | 2250 |

-continued

| | | | | |
|---|---|---|---|---|
| Molecular Weight | | 340 | 20 | 296 |
| Mole Fraction | | 86% | 14% | 100% |
| Heat Capacity | (J/gmole.C) | 1278 | 19 | 1106 |
| Combust. Enthalpy @ 25C | (J/gmole) | 1.68E + 07 | 1.07E + 06 | 1.47E + 07 |
| (b) Low Density Heavy Oil | | | | |
| Density | (kg/m$^3$) | 944 | 866 | 934 |
| Viscosity | (cp) | 488 | 17 | 308 |
| Molecular Weight | | 340 | 20 | 296 |
| Mole Fraction | | 86% | 14% | 100% |
| Heat Capacity | (J/gmole.C) | 1278 | 19 | 1106 |
| Combust. Enthalpy @ 25C | (J/gmole) | 1.68E + 07 | 1.07E + 06 | 1.47E + 07 |

The wells were controlled using the following constraints:

| | |
|---|---|
| Air injection pressure (Max) = | 6000 Kpa |
| Production pressure (Min) = | 500 Kpa |
| Liquid production rate (Max) = | 240 m$^3$/d |
| Steam production rate (Max) = | 9.6 m$^3$/d |
| Liquid producer gas rate (Max) = | 9600 m$^3$/d |
| Gas-producer gas rate (Max) = | 288000 m$^3$/d |

Operation of the model with the above parameters provided a prediction of the performance of the process over time. A five year timeline was modelled. Two types of reservoirs were modelled; a reservoir containing high density heavy oil, and one containing low density heavy oil.

In both reservoir cases, the reservoir was treated by steam pre-heating at 6000 Kpa for three months. Oil rates of about 80 m$^3$/d were achieved at the oil production well during pre-heat.

Air injection was started in the fourth month. Characteristically, oil production at the gas production wells declined quickly, while the horizontal oil production well oil rates increased.

After some years into the production, when oxygen breakthrough was detected (Oxygen concentrations >1%) at a gas production well, the gas production well was shut in. Air injection was reduced to minimum levels, and liquid production continued at diminishing rates. The residual heat in the reservoir formation continued to heat and mobilize new oil, albeit at lower and lower rates. The model production forecasts were continued until oil production at the horizontal oil production well dropped to the economic limit of 20 m$^3$/day per well.

Figure 6:
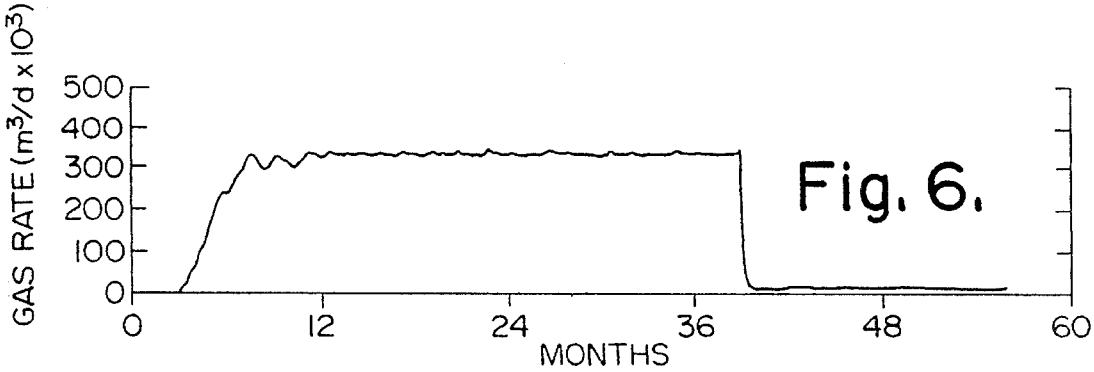
FIG. 6 is a chronological history of the modelled air injection rate performance for a high density heavy oil-containing reservoir modelled according to FIG. 4.

Referring specifically to the high density heavy oil reservoir case whose data are set forth in FIG. 6, the model presents the air injection rates as starting in the fourth month and rising steeply to stable rates of about 300,000 m$^3$/day. About three years later, oxygen breakthrough was detected and the air injection rate was reduced to a very low level.

Figure 7:
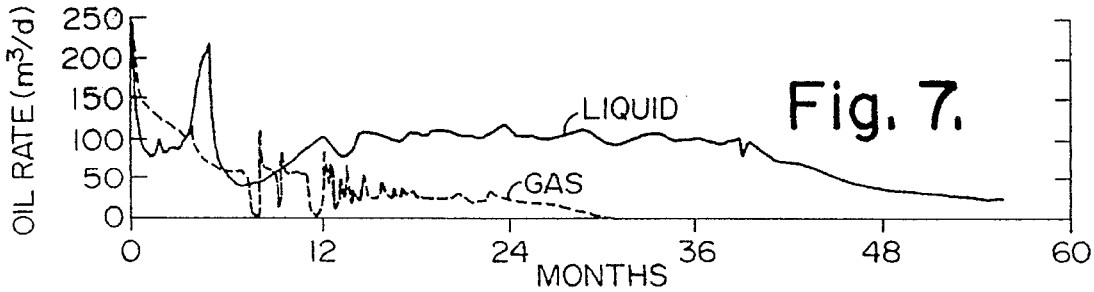
FIG. 7 is a chronological history of the modelled oil production performance at the gas production and oil production wells, corresponding to the case presented in FIG. 6.

Referring to FIG. 7, the oil production rates at the horizontal oil production well were seen to rise steadily, achieving a steady production rate of about 100 m$^3$/day which was maintained for over 3 years. Oil production at the gas production well fell rapidly with the increase in air injection, falling to economic limits in less than one year, and to non-detectable levels within two years.

When the air injection rate was reduced, the oil production rates at the horizontal production well were seen, correspondingly, to steadily diminish over the following 1.5 years to the economic limit.

Figure 8:
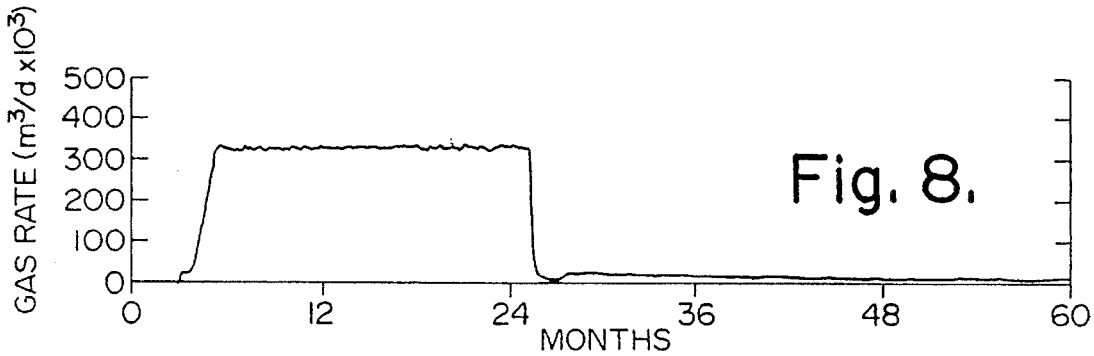
FIG. 8 is a chronological history of the modelled air injection rate for a low density heavy oil-containing reservoir modelled according to FIG. 4.
Figure 9:
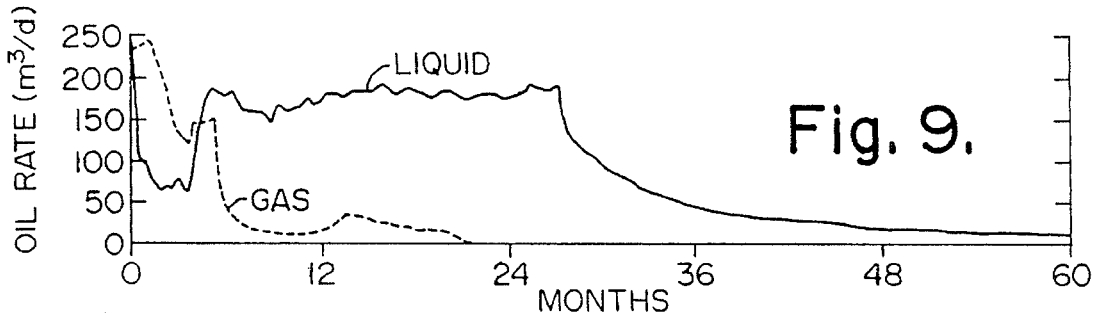
FIG. 9 is a chronological history of the modelled oil production performance at the gas production and oil production wells, corresponding to the case presented in FIG. 8.

Referring now to FIGS. 8 and 9, similar modelling was performed for a low density heavy oil reservoir. Oxygen breakthrough was detected much sooner (after two years) than in the high density heavy oil case, but the oil production through the steady state period was significantly higher at 180 m$^3$/day. Once the air injection was reduced, economic oil production was possible for a remaining 2.5 years.

In an alternative procedure, it may be desirable as a preliminary step to inject gas through the injection wells, prior to initiating combustion, to establish gas communication with the gas production wells.

The scope of the invention is set forth in the claims now following.

The embodiments of the invention in which an exclusive property or privilege is claimed are defined as follows:

1. An in-situ process for recovering oil from an oil-bearing reservoir, comprising:

providing a row of vertical injection wells completed for injection at an interval in the upper part of the reservoir, for injecting oxygen-containing gas into the reservoir to support a combustion front therein;

providing at least one gas production well spaced laterally from the row and completed in the reservoir, for producing the combustion gases;

providing a horizontal oil production well, positioned in spaced relation below the injection interval and being generally aligned with the row, for producing oil and water in liquid form;

injecting an oxygen-containing gas at less than fracturing pressure through each injection well and establishing a combustion front emanating from each such well to form a hot gas-containing fluid-transmissive chamber extending around each injection well and down to the oil production well, so that heated oil and water will drain downwardly through the chamber under the influence of gravity, said combustion front further being operative to produce combustion gases which flow through the reservoir toward the gas production wells; and producing hot oil and water in liquid form through the horizontal oil production well and combustion gases through the gas production well.

2. The process as set forth in claim 1 wherein:

a plurality of gas production wells are provided, said wells being completed for production at intervals located in the upper part of the reservoir.

3. The process as set forth in claims 1 or 2 wherein the gas production rate through the horizontal well is controlled at low rates to maintain a head of liquid over the oil production well.

4. The process as set forth in claim 1 comprising:

cyclically steam stimulating the injection wells and oil production well, before initiating injection of oxygen-containing gas, to develop fluid communication between the injection wells and the oil production well.

5. The process as set forth in claim 1 or 2 wherein gas is injected through the injection wells prior to combustion operations until gas communication is established with the gas production wells.

6. An in-situ process for recovering oil from a heavy oil-containing reservoir, comprising:

providing a row of vertical injection wells completed for injection at an interval in the upper part of the reservoir, for injecting oxygen-containing gas into the reservoir to support a combustion front therein;

providing at least one gas production well spaced laterally from the row and completed in the upper part of the reservoir, for producing the combustion gases;

providing a horizontal oil production well, positioned in spaced relation below the injection interval and being generally aligned with the row, for producing oil and water in liquid form;

cyclically steam stimulating the injection wells and oil production well, before initiating injection of oxygen-containing gas, to develop fluid communication between the injection wells and the oil production well;

injecting an oxygen-containing gas at less than fracturing pressure through each injection well and establishing a combustion front emanating from each such well to form a hot gas-containing fluid-transmissive chamber extending around each injection well and down to the oil production well, so that heated oil and water will drain downwardly through the chamber under the influence of gravity, said combustion front further being operative to produce combustion gases which flow through the reservoir toward the gas production wells; and producing hot oil and water in liquid form through the horizontal oil production well and combustion gases through the gas production well.

* * * * *